US005953750A

United States Patent [19]

Stella

[11] Patent Number: 5,953,750

[45] Date of Patent: Sep. 21, 1999

[54] TORSO WARMER FOR A BUOYANCY COMPENSATOR

[75] Inventor: Joe Stella, Ipswich, Mass.

[73] Assignee: Dacor Corporation, Northfield, Ill.

[21] Appl. No.: 09/012,314

[22] Filed: Jan. 23, 1998

[51] Int. Cl.[6] ..... B63C 11/04; B63C 11/08

[52] U.S. Cl. ..... 2/2.15; 2/462; 405/186; 441/106

[58] Field of Search ..... 2/462, 102, 2.15, 2/2.16, 2.17; 441/106, 108, 111; 405/186

[56] References Cited

U.S. PATENT DOCUMENTS

| | | |
|---|---|---|
| 2,981,954 | 5/1961 | Garbellano . |
| 3,105,359 | 10/1963 | Ellis . |
| 3,436,777 | 4/1969 | Greenwood . |
| 3,733,054 | 5/1973 | Schultz . |
| 4,293,957 | 10/1981 | Melarvie . |
| 4,429,419 | 2/1984 | Snyder . |
| 4,555,234 | 11/1985 | Kent . |
| 4,778,435 | 10/1988 | Hattori . |
| 4,946,313 | 8/1990 | Augurelli . |
| 4,952,095 | 8/1990 | Walters . |
| 5,020,941 | 6/1991 | Bulin et al. . |
| 5,046,894 | 9/1991 | Bergstrom . |
| 5,249,890 | 10/1993 | Bergstrom . |
| 5,256,094 | 10/1993 | Canna . |
| 5,295,765 | 3/1994 | Choi . |
| 5,363,790 | 11/1994 | Matsuoka . |
| 5,516,234 | 5/1996 | Duchesne . |
| 5,522,679 | 6/1996 | Eungard . |
| 5,562,513 | 10/1996 | Kaiser . |
| 5,641,247 | 6/1997 | Seligman . |
| 5,662,433 | 9/1997 | Seligman . |

*Primary Examiner*—John J. Calvert
*Assistant Examiner*—Shirra L. Jenkins
*Attorney, Agent, or Firm*—Greer, Burns & Crain, Ltd.

[57] ABSTRACT

A diving jacket for retaining warmth of a diver's torso is provided with an inner surface and an outer surface. The outer surface of the diving jacket is formed from first and second front torso portions fastened to a back portion. A releasable fastener for releasably attaching the first front torso portion to the second front torso portion is also preferably secured to the diving jacket. At least one loop is attached to the outer surface of the diving jacket to define an aperture that is dimensioned to accommodate a corresponding strap of a buoyancy compensator for allowing the buoyancy compensator to be secured to the outer surface of the diving jacket.

15 Claims, 3 Drawing Sheets

TORSO WARMER FOR A BUOYANCY COMPENSATOR

BACKGROUND OF THE INVENTION

This invention generally relates to the field of diving equipment and more specifically to a diving jacket which may be worn in combination with a buoyancy compensator. A buoyancy compensator ("BC") is a vest-shaped device which is worn about a scuba diver's torso. To secure the BC in place, the diver wraps several straps from the device around his torso and connects them together. In most versions, the diver's air tank is also attached to the BC. By inflating and deflating an air bladder present in the BC, a diver is able to adjust his buoyancy in the water. Since a diver's buoyancy decreases with depth, the adjustibility of the BC allows the diver to swim at a desired depth while maintaining neutral buoyancy.

A major problem experienced by divers is the loss of body warmth through their torso, especially as depth increases. In the past, the only solution a diver had for retaining body warmth during diving was to wear a wetsuit underneath the BC. For extremely cold water diving, "dry suits" are utilized, also in conjunction with BC's. Therefore, a BC should be selected which will properly fit over the wetsuit and/or the dry suit.

Divers in relatively warmer or tropical waters may also feel the need for additional warmth, but do not require the degree of warmth provided by a full wetsuit. Further, these divers may want to avoid the bother and/or discomfort affiliated with use of a full wetsuit.

Another disadvantage of conventional BC's is that the air tank, attached to the BC, is not adequately supported on the diver's back since the BC usually does not snugly fit against the diver's body. This causes the air tank to move relative to the diver's body which hinders diving. Also, when a diver wears a BC over a wetsuit, initially a very snug fit is achieved which prevents unwanted movement of the air tank. However, as the diving depth increases, the weight of the water above the diver causes the wetsuit to contract. This contraction causes the fit between the BC and the wetsuit to loosen, allowing the air tank to move relative to the diver's body.

It is therefore an object of the present invention to provide an improved diving jacket that may be attached to a BC which will retain the diver's body warmth.

A further object of the present invention is to provide an improved diving jacket that will provide added support and stabilization to an air tank when worn in conjunction with a BC.

Another object of the present invention is to provide an improved diving jacket that may be attached to a BC, which, when worn over the top of a wetsuit, prevents the unwanted movement of the air tank.

BRIEF SUMMARY OF THE INVENTION

The above-identified objects of the present invention are met or exceeded by providing a diving jacket which provides the advantage of retaining the body warmth of a diver. The present jacket can act as an additional warmer to the complete wetsuit, as an additional warmer to the LYCRA® brand material "skin" suit, or as the primary warmer worn with a swimsuit. Further, the present diving jacket incorporates the feature of loops attached to the outer surface of the diving jacket for receiving the straps of a BC. Integrating the BC with the diving jacket in this manner greatly increases stabilization of the air tank since the diving jacket provides a tight fit between the diver's body and the BC. When the diving jacket and BC are worn in conjunction with a wetsuit during deep dives, the diving jacket helps to retain the diver's body warmth and maintains the air tank in a stabilized position. In effect, the air tank is "attached" to the body suit.

As the wetsuit contracts with the increased diving depth, so to does the diving jacket. However, as the diving jacket contracts, the loops pull the BC close to the diver's body. This provides the advantage of maintaining a snug fit between the BC and the diver's body, thereby improving air tank stabilization. Moreover, as the diver rises to the surface, the diving jacket expands, causing the loops to reduce their pull on the BC. Therefore, stabilization of the air tank is maintained since the wetsuit also expands.

More specifically, a diving jacket for retaining warmth of a diver's torso is provided with an inner surface and an outer surface. The outer surface is defined by first and second front torso portions fastened to a back portion. The first and second torso portions each have a shoulder end and a waist end. At least one loop is attached to the outer surface of the diving jacket to define an aperture that is dimensioned to accommodate a corresponding strap of a buoyancy compensator for allowing the buoyancy compensator to be secured to the outer surface of the diving jacket. In the preferred embodiment, a releasable fastener is provided for securing opposing edges of the first and second front torso portions.

DETAILED DESCRIPTION OF THE INVENTION

Figure 1:
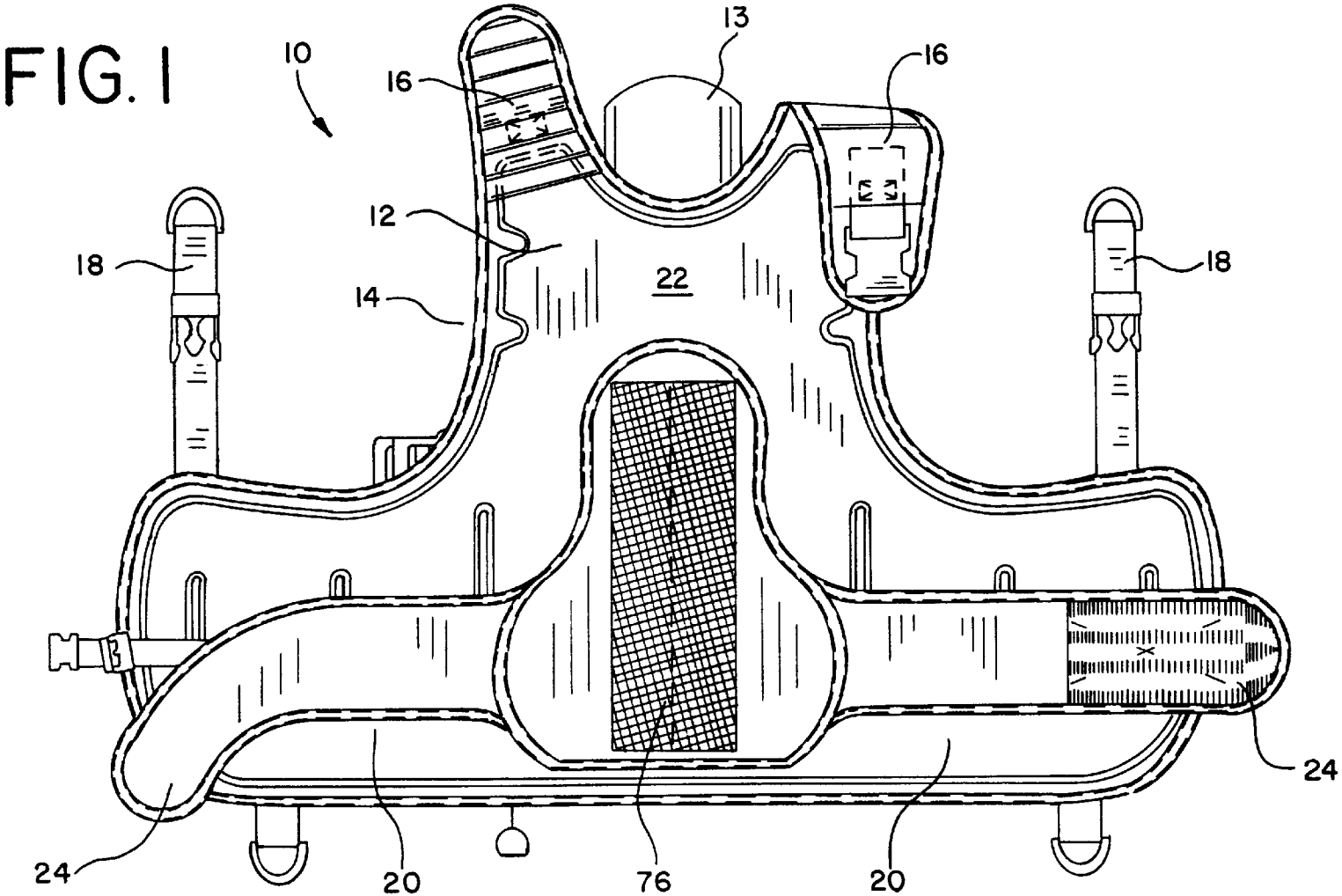
FIG. 1 is a front view of a conventional buoyancy compensator shown in an open position.

Referring now to FIG. 1, a conventional buoyancy compensator ("BC") is generally designated 10, and includes a back portion 12 to which a generally cylindrical air tank 13 is connected to the BC's outer side 14. Preferably, two over-the-shoulder straps 16 are attached to the back portion 12 of the BC 10. In use, these over-the-shoulder straps 16 are placed over the shoulders of a diver and are releasably engaged with coordinating vertical straps 18, thereby securing the BC 10 to the diver. Additionally, a cummerbund strap 20 is attached to an inside surface 22 of the BC 10 and is provided with a pair of ends, each having an attachment portion 24 of VELCRO® brand hook and loop or equivalent easily releasable fastener materials. The attachment portion 24 permits the cummerbund strap 20 to be fastened together after being placed around a diver's waist. The cummerbund strap 20 further secures the BC 10 to the diver's body.

An air bladder is defined between the back portion 12 and the outer side 14 of the BC 10, which are sealed together at their corresponding peripheral edges as is known in the art. The air bladder may be inflated with air provided either from the air tank 13 or manually by the diver through an oral inflation tube (not shown). By inflating and deflating the air bladder, a diver is able to adjust his buoyancy while diving to maintain neutral buoyancy. The manner of forming, inflating and deflating the air bladder, is well known in the scuba diving art, and such is described in commonly assigned U.S. Pat. No. 5,522,679, which is incorporated herein by reference.

Figure 3:
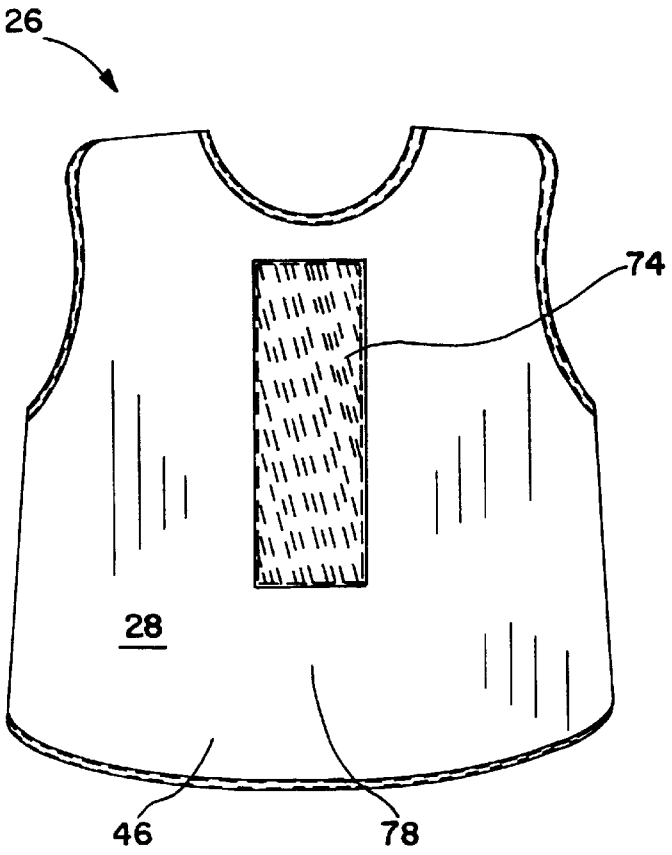
FIG. 3 is a rear view of the present diving jacket.
Figure 2:
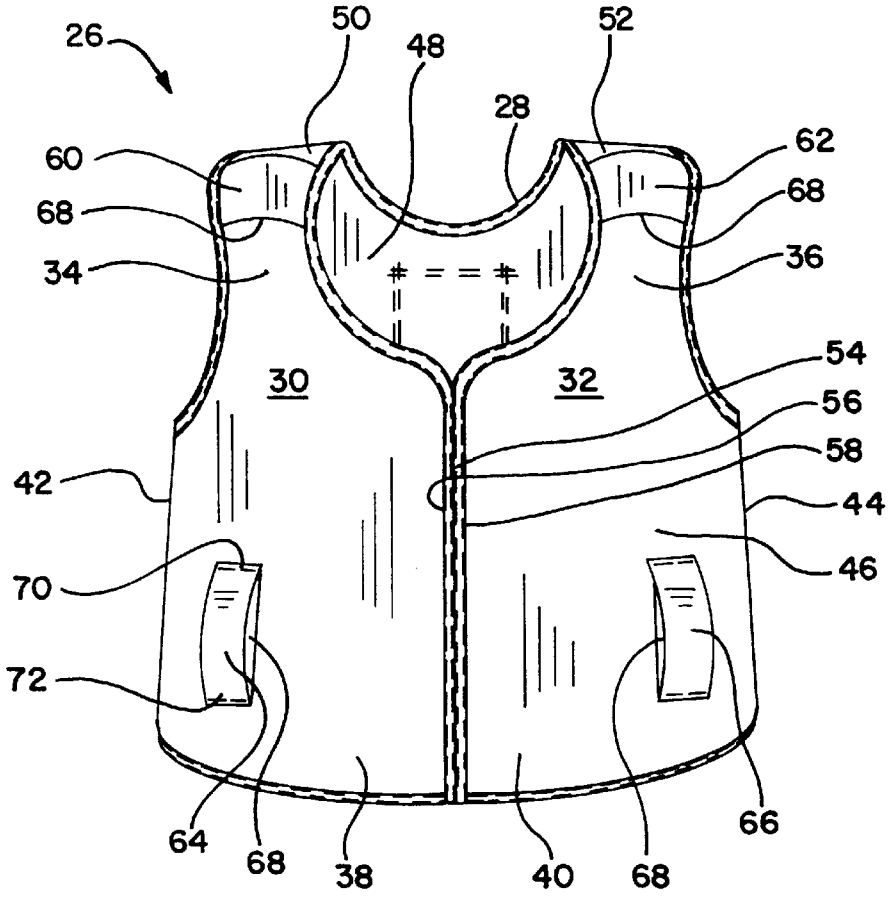
FIG. 2 is a front view of the present diving jacket.

Referring now to FIGS. 2 and 3, a diving jacket of the present invention is generally designated 26. A major object of the present invention is to prevent the escape of body warmth from the diver's torso. This is accomplished by fabricating the diving jacket 26 from a preferably stretchable insulating material that conforms snugly to the diver's body. In the preferred embodiment, the material used for the diving jacket 26 is comprised of a blend of neoprene and nylon. The preferred relative proportions of those components is about 80% neoprene and about 20% nylon. However, any stretchable material or combination of materials which insulates a diver's body is also contemplated.

The diving jacket 26 includes a back portion 28, a first front torso portion 30, and a second front torso portion 32. The first and second front torso portions 30, 32 each have an upper or shoulder end 34. 36, which correspond to the shoulder of a diver, and a lower or waist end 38, 40, which correspond to the waist of a diver. In the preferred embodiment, the shoulder ends 34, 36 of the first and second front torso portions 30, 32 are fastened to the back portion 28. Further, corresponding outside edges 42, 44 of the first and second front torso portions 30, 32 are also fastened to the back portion 28, thereby providing the diving jacket 26 with an outer surface 46 and an inner surface 48. It is preferred that the portions 28, 30, 32 are fastened to each other by stitching, however, it is contemplated that other fastening systems may be used, such as adhesives, ultrasonic welding and/or combinations of the above.

In an alternate embodiment, additional material may be inserted between the first and second front torso portions 30, 32 and the back portion 28. Such an embodiment (shown in FIG. 2), includes of first and second shoulder portions 50, 52 fastened to the shoulder ends 34, 36 of the first and second torso portions 30, 32. The first and second shoulder portions 50, 52 are then fastened to the back portion 28, thereby completing the formation of the diving jacket 26. These added shoulder portions 50, 52 may be fabricated from the same material as the diving jacket 26 or from a different material. The use of a different material for the first and second shoulder portions 50, 52 may provide resistance to chafing from the over-the-shoulder straps 16 of the BC 10.

A releasable fastener 54 is secured to opposed inside edges 56, 58 of the first and second front torso portions 30, 32. The releasable fastener 54 is designed to allow the diving jacket 26 to be closed by releasably attaching the corresponding inside edges 56, 58 of the first and second front torso portions 30, 32. The releasable fastener 54 may be in the form of a VELCRO® brand hook and loop fastener arrangement, a zipper, buttons, a combination of these items, or any other well known method of releasably attaching material together.

Referring now to FIG. 2, at least one loop is attached to the outer surface 46 of the diving jacket 26, and in the preferred embodiment of the present invention four loops 60, 62, 64, 66 are provided. Each loop 60, 62, 64, 66 is attached to the diving jacket so that an aperture 68 is defined which will accept a corresponding strap 16, 20 of the BC 10. By inserting at least one of the straps 16, 20 of the BC 10 through a corresponding loop 60, 62, 64, 66, the BC 10 is coupled with the diving jacket 26. A preferred method of forming the loops is to attach two opposite ends of material 70, 72 to the outer surface 46 of the diving jacket 26, thereby forming the aperture 68 between the loop material and the outer surface 46 of the diving jacket 26.

More specifically, in the preferred embodiment, the first loop 60 is attached to the shoulder end 34 of the first front torso portion 30, and the second loop 62 is attached to the shoulder end 36 of the second front torso portion 32. These loops 60, 62 are constructed and arranged to allow the over-the-shoulder straps 16 of the BC 10 to be passed through the corresponding apertures 68. Additionally, the third loop 64 is attached near the waist end 38 of the first front torso portion 30, and the fourth loop 66 is attached near the waist end 40 of the second front torso portion 32. The third and fourth loops 64, 66 are positioned to allow the cummerbund strap 20 of the BC 10 to pass through the apertures 68 of these loops. To aid the diver in fastening the ends of the cummerbund strap 20 together, the third and fourth loops 64, 66 should be positioned and dimensioned to allow the attachment portions 24 to easily slide therethrough. When the over-the-shoulder straps 16 and the cummerbund strap 20 of the BC 10 are inserted through the corresponding loops 60, 62, 64, 66 on the diving jacket 26 and fastened together, the diving jacket 26 and the BC 10 function together, and provide support to the air tank 13 while retaining the body warmth of the diver.

Referring now to FIGS. 1 and 3, another feature of the present diving jacket 26 is that it provides additional support for the air tank 13 by the inclusion of a fastener which releasably attaches the back portion 28 of the outer surface 46 of the diving jacket 26 to the inner surface 22 of the BC. A first fastener 74 (best seen in FIG. 3) is secured to the back portion 28 of the outer surface 46 of the diving jacket 26 and is positioned to engage a second fastener 76 (best seen in FIG. 1) which is secured to the inside surface 22 of the BC 10. The fasteners 74, 76 are preferably in the form of a VELCRO® brand hook and loop fastener arrangement, but they could also be in the form of a zipper, buttons, a combination of these items, or any other well known manner of releasably attaching garment-type material together. The first fastener 74, which is secured to the diving jacket 26, is preferably placed in the middle or spine region 78 of the diving jacket 26. Therefore, the second fastener 76, which is secured to the BC 10, is similarly located on the BC to cooperatively engage the first fastener 74. Placing these fasteners 74, 76 in the spine region 78 of the diver provides an optimal amount of air tank 13 support for the diver.

Figure 5:
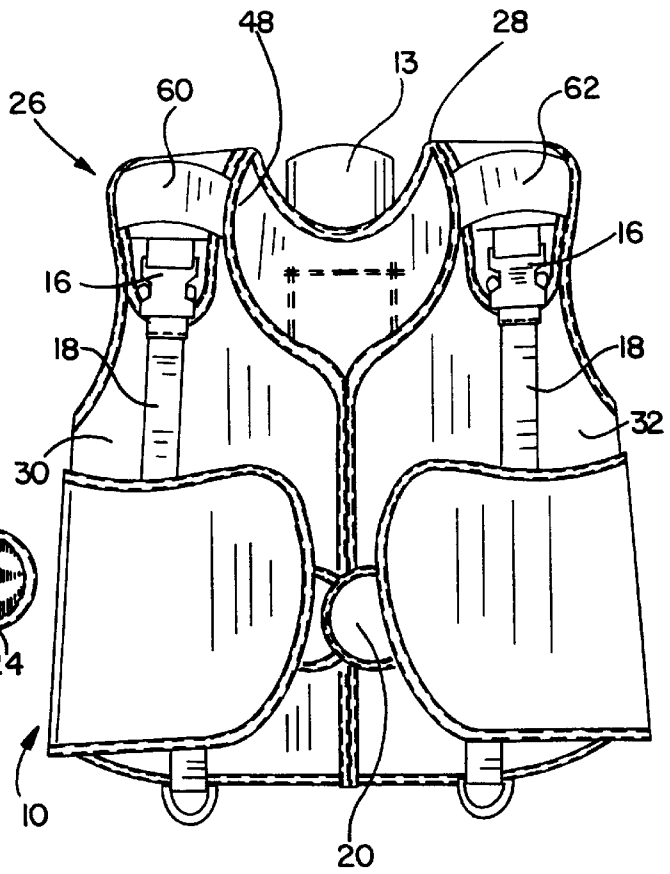
FIG. 5 is a front view of the present diving jacket assembled with a conventional buoyancy compensator.
Figure 4:
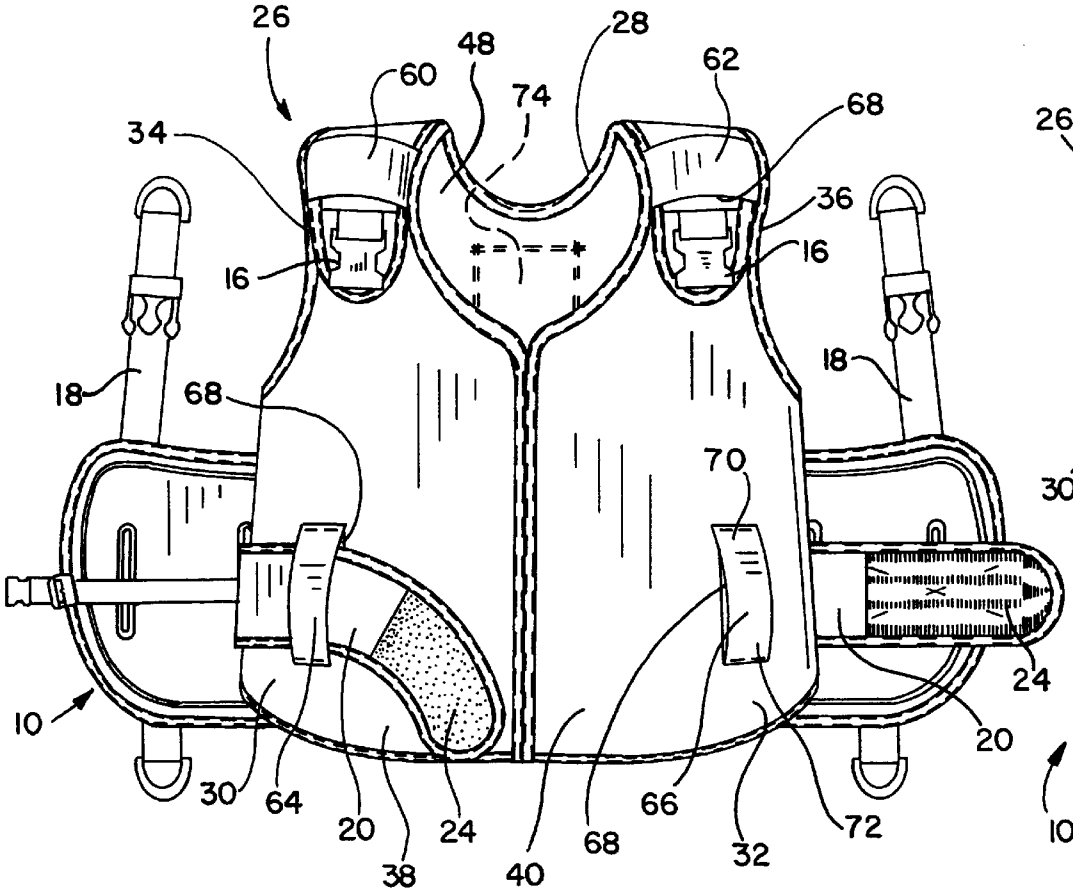
FIG. 4 is a front view of a partial assembly of the present diving jacket and a conventional buoyancy compensator.

Referring now to FIGS. 4 and 5, although the jacket 26 may be worn without a BC (and the BC may be worn without the jacket 26), the operation of the present diving jacket 26 in combination with a conventional BC 10 will be explained. The diving jacket 26 is attached to the BC 10 by connecting together the first fastener 74, located on the back portion 28, with the second fastener 76, located on the inside surface 22. The over-the-shoulder straps 16 and the cummerbund strap 20 of the BC 10 are then passed through the corresponding loops 60, 62, 64, 66 on the diving jacket 10 and fastened around the diver's body. In FIG. 5, the diving jacket 26 with the BC 10 fully attached is shown. As a diver proceeds into deeper, colder water, the diving jacket 26 helps to retain the diver's body warmth, even if a conventional wetsuit is also worn. A diver may therefore dive more comfortably, and at deeper depths, for longer periods of time. Further, since the BC 10 is relatively more tightly held against the diver by the diving jacket 26, the use of the diving jacket 26 with the BC provides added stabilization for the air tank 13. As the diver descends to greater depths, the diving jacket 26 prevents loss of air tank 13 stabilization by pulling the BC 10 back towards the diver's body. Therefore, the diver may maneuver more easily underwater since the air tank 13 is prevented from sliding and/or shifting about the diver's back.

While the principles of the invention have been described above in connection with a specific apparatus and application, it is to be understood that this description is made only by way of example and not as a limitation on the scope of the invention. As one of ordinary skill in the art will appreciate, modifications and variations may be made to the present torso warming diving jacket without departing from the scope and spirit of the invention as reflected in the following claims.

I claim:

1. A diving jacket for retaining warmth of a diver's torso, comprising:

an inner surface and an outer surface;

said outer surface being defined by a first front torso portion, a second front torso portion, and a back portion, said first and second portions being fastened to said back portion;

said first and second front torso portions each having a shoulder end and a waist end;

at least one loop attached to said outer surface to define an aperture between said loop and said outer surface;

each said aperture dimensioned to accommodate a corresponding strap of a buoyancy compensator for allowing the buoyancy compensator to be secured to said outer surface.

2. The diving jacket as defined in claim 1 further including a first shoulder portion fastened to said shoulder end of said first front torso portion, a second shoulder portion fastened to said shoulder end of said second front torso portion, and a back portion fastened to both said first and second shoulder portions.

3. The diving jacket as defined in claim 1 further comprising:

a first fastener secured to said back portion of said outer surface and being disposed thereon to engage a second fastener mounted on an inside surface of the buoyancy compensator.

4. The diving jacket as defined in claim 3 wherein said first fastener is disposed in a spine region of said diving jacket.

5. The diving jacket as defined in claim 3 wherein said first fastener is comprised of hooks and engage said second fastener which is comprised of loops.

6. The diving jacket as defined in claim 1 wherein said diving jacket is fabricated from a stretchable insulating material.

7. The diving jacket as defined in claim 6 wherein said stretchable insulating material is comprised of a blend of neoprene and nylon.

8. The diving jacket as defined in claim 1 wherein said at least one loop includes a first loop attached to said shoulder end of said first front torso portion, a second loop attached to said shoulder end of said second front torso portion, a third loop attached to said waist end of said first front torso portion, and a fourth loop attached to said waist end of said second front torso portion.

9. The diving jacket as defined in claim 8 wherein said aperture of said first loop and said aperture of said second loop are disposed to receive an over-the-shoulder strap of the buoyancy compensator; and said aperture of said third loop and said aperture of said fourth loop are disposed to receive a cummerbund strap of the buoyancy compensator.

10. The diving jacket as defined in claim 1 further including a releasable fastener for joining corresponding edges of said first and second front torso portions.

11. A combination of a diving jacket and a buoyancy compensator comprising:

a buoyancy compensator having a plurality of straps and an inside surface;

a diving jacket with an outer surface;

a means for attaching said buoyancy compensator to said outer surface of said diving jacket; and a means for securing a back outer surface portion of said diving jacket to said inside surface of said buoyancy compensator.

12. The combination as defined in claim 11 wherein said means for attaching comprises a plurality of loops disposed on said outer surface, each said loop constructed and arranged for receiving a corresponding one of said straps of said buoyancy compensator.

13. The combination as defined in claim 11 wherein said means for securing comprises a two portion hook and loop fastener with one fastener portion disposed on said back outer surface portion of said diving jacket and the other fastener portion on said inside surface of said buoyancy compensator.

14. A combination of a diving jacket and a buoyancy compensator comprising:

a buoyancy compensator including at least one over-the-shoulder strap and at least one cummerbund strap;

a diving jacket having an inner surface and an outer surface;

said outer surface being defined by a first front torso portion and a second front torso portion, both fastened to a back portion;

said first and second front torso portions each having a shoulder end and a waist end;

a releasable fastener for releasably attaching said first front torso portion to said second front torso portion;

at least one loop attached to said outer surface;

each said at least one loop having two ends attached to said outer surface to define an aperture between said loop and said outer surface;

each said aperture dimensioned to accommodate one of said corresponding straps of said buoyancy compensator for allowing the buoyancy compensator to be secured to said outer surface of said diving jacket.

15. The combination as defined in claim 14 wherein said back portion of said jacket is releasably fastened to an inner surface of said buoyancy compensator for providing support for an air tank attached to said buoyancy compensator.

* * * * *